US006007220A

United States Patent [19]

Wordin

[11] Patent Number: 6,007,220

[45] Date of Patent: Dec. 28, 1999

[54] REFLECTORS FOR FLUORESCENT LIGHT FIXTURES

[75] Inventor: John Joseph Wordin, Shelley, Id.

[73] Assignee: Innovative Engineering Solutions, Inc, Idaho Falls, Id.

[21] Appl. No.: 08/746,548

[22] Filed: Nov. 13, 1996

[51] Int. Cl.[6] ..... F21V 7/00

[52] U.S. Cl. ..... 362/296; 362/347

[58] Field of Search ..... 362/296, 297, 362/341, 343, 346, 347, 350, 344

[56] References Cited

U.S. PATENT DOCUMENTS

| | | | |
|---|---|---|---|
| 3,492,474 | 1/1970 | Yamaguchi et al. | 362/350 |
| 4,089,047 | 5/1978 | Lüderitz | 362/297 |
| 4,295,186 | 10/1981 | Sugiura et al. | 362/297 |
| 4,683,526 | 7/1987 | Krogsrud et al. | 362/346 |
| 4,868,727 | 9/1989 | Ponds et al. | 362/344 |
| 5,136,491 | 8/1992 | Kano | 362/346 |
| 5,408,363 | 4/1995 | Kano | 359/869 |

OTHER PUBLICATIONS

Reflection Angles from conic sections.

*Primary Examiner*—Stephen Husar

[57] ABSTRACT

A single elongated light source fixture is disclosed. The fixture, comprising a hyperbolic reflector combined with a single elongated light source such as a fluorescent tube, provides adequate levels of illumination while substantially saving energy usage compared to existing light fixtures.

1 Claim, 2 Drawing Sheets

REFLECTORS FOR FLUORESCENT LIGHT FIXTURES

BACKGROUND

This invention relates to reflectors, specifically, to reflectors in the cross-sectional shape of conic sections for fluorescent light fixtures. Other patents have taught how to use reflectors on light fixtures which have a cross-sectional shape generally hyperbolic, generally elliptic, or generally parabolic. For example, U.S. Pat. No. 4,089,047 uses reflectors with elliptical cross-sections with the feature of one set of focuses of the ellipses being coincident and with the other focuses located at the ceiling level. These incandescent light fixtures use only reflected light with the embodiment designed such that all direct light coming from the light source is blocked. This patent would restrict the fixture to something small in diameter in order to meet the requirement of having one set of focuses coincident. Having all direct light blocked seriously limits the efficiency and usefulness of the lamp. A hyperbolic reflection surface is added to the lamp in another embodiment which is described, however, no diagram of the configuration is provided and the juxtaposition of the light source and the focus of the hyperbola is not taught.

U.S. Pat. No. 4,683,526 claims a desk lamp with a reflector in the shape of a parabola formed from a series of triangular facets. This patent claims a method to approximately construct at reasonable cost, a curved reflection surface to improve the light delivery from the lamp.

Although there are a number of fluorescent light fixtures on the market, few seem to utilize the direct light and reflected light coming from the light source to full advantage. Reflection surfaces are painted milky white which has a medium reflectance. Some reflectors are being made on special order to retrofit existing light fixtures, reduce the number of fluorescent tubes, and thus improve the light efficiency and energy utilization. These retrofit reflectors are fabricated by bending them into rectangular facets thus approximating a parabola in cross-sectional shape. A highly reflective material, such as Silverlux by 3M Company, applied to the surface of a thin aluminum sheet, is being used on these reflectors.

Generally, fluorescent light fixtures which are designed to provide illumination for an area should:

a. Uniformly illuminate the area.

b. Minimize the formation of shadows.

c. Provide light agreeable for human activity.

d. Minimize the use of energy while providing an adequate level of illumination.

Accordingly, there is a need for new, optimized, light fixtures which will provide uniform light patterns coupled with an adequate level of illumination, and providing substantial energy savings. They must be suitable for use in new building construction or retrofit to existing structures, for illumination of art works or advertising signs, and for use in homes, stores, and offices.

OBJECTS AND ADVANTAGES

Modern civilization has moved indoors and functions around the clock. Thus, there is a need for low cost lighting in buildings, offices, warehouses, barns, museums, homes, and where ever there is human activity. Electrical rates continue to slowly rise and, as a strategy to cope with these rate increases, conservation is one approach. Because much human activity takes place indoors under artificial light, the light level must be high enough so quality work can be conducted, sporting events well lite, and kitchen areas adequately lite for food preparation. Shadows produced by point sources of light are a nuisance. Similarly, uneven lighting in work areas creates eye strain. Uneven lighting of advertising displays sacrifices impact. Light and dark areas on paintings or tapestries on exhibit in art museums detracts from the presentation of such artistic works.

Approximately 80% of what human beings learn comes through the sense of sight. We see objects by reflected light. Therefore, it is important that human factors of illumination in a room, office, or other work place be bright, have good color rendition, and exhibit a character and quality which is most pleasing.

Accordingly, it is an object of this invention to provide an occupied area with fluorescent light fixtures which provide an adequate level of illumination while substantially saving energy compared to existing light fixtures. In addition, another object of this invention is to minimize or eliminate shadows and to provide an illuminated area that is lighted in a uniform manner. It is a further object of this invention to provide illumination to an area by light fixtures projecting light which has a most pleasing character and quality.

These reflectors can be used in conjunction with other sources of electromagnetic radiation such as heating elements, infrared, and ultraviolet light sources.

THEORY OF OPERATION

The law of reflection is the essential physical principle upon which this invention is based. It states:

When an energy wave incident upon a flat or curved surface is reflected, the angles of incidence and of reflection are equal and lie in the same plane.

Various materials and types of surfaces reflect light at different reflectance. A diffuse surface can reflect 10% to 60% of incident light while a specular surface can reflect 80% to 95% of the incident light. Since high efficiency is desired to achieve energy savings, the surface finish chosen is specular. Polished aluminum, polished stainless steel, and a plastic laminate called Silverlux by 3M Company qualify as possible candidates for reflector surfaces. Material selection for the reflector surface is not limited to this list of materials, others surely also qualify.

A second ingredient needed is the shape of the reflector. The classic shape used in the past for light fixtures has been the parabola. For this current invention, selection is opened up for use of any of the conic sections; hyperbola, ellipse, or parabola, used singly or in various combinations, in 2-dimensional or 3-dimensional shapes. These cross-sectional shapes are selected because there is a primary focal point and a virtual focal point associated with each of the conic sections and the radiation, light, or heat source can be located coincident with the primary focal point. The virtual focal point defines the type of curve with the defining parameters for the construction of the curve. The axis of the conic section can be angled in order to throw the light in a particular direction. No attempt is made to bring the reflected light to a focus for purposes of creating an image as is usually done in optical devices such as a reflector telescope, therefore, these are called non-imaging embodiments. In each case, the illuminated surface receives the direct light plus the light reflected from the reflector.

When a reflector in the shape of a hyperbola is located behind an extended light source, and the center of the radiation source is located coincident with the primary focus of the hyperbola, the reflected light appears to have originated from the other focus, herein referred to as the virtual focus, of the hyperbola. See FIG. 1*a*. In this case the pencil of light rays appear as a fan-shape providing a natural diffusion pattern of reflected light emanating from the virtual focus. Thus, the direct radiation is a pencil of light rays from the primary focus and the reflected radiation is a pencil of light rays from the virtual focus. This duel set of light sources tends to eliminate shadows from objects placed under the light fixture. The hyperbolic reflector provides a broad diffusing light pattern on the illuminated surface.

When a reflector in the shape of an ellipse is located behind an elongated light source, and the center of the light source is located coincident with the primary focus of the ellipse, the reflected light rays will tend to pass through the virtual focus of the ellipse, and, when the geometry is such that the light is unobstructed, and will form a pencil of light rays fanning out from the virtual focus. See FIG. 1*b*. In this case as in the case of the hyperbola, this fan-shaped pencil of light rays seemingly coming from the virtual focus provides a natural diffusion of the reflected light. The elliptical reflector provides a narrow diffusing light pattern on the illuminated surface.

When a reflector in the shape of a parabola is located behind an elongated light source such as a fluorescent light tube, and the center of the light source is located coincident with the focus of the parabola, reflected light rays are approximately parallel to the axis of the parabola and to each other. It appears as if the reflected light originated from an independent source located at infinite. See FIG. 1*c*.

DRAWING FIGURES

FIGS. 1*a*, 1*b*, 1*c* are general views of reflected energy from hyperbolic, elliptic, and parabolic reflectors.

FIG. 2 shows a single elongated light source fixture having a hyperbolic reflector with a single elongated light source such as a fluorescent tube.

DESCRIPTION OF THE DRAWINGS

The preferred embodiment for this invention is shown in FIG. 2, where a fluorescent light fixture with hyperbolic cross-sectional specular reflector shapes are presented.

Figure 1:
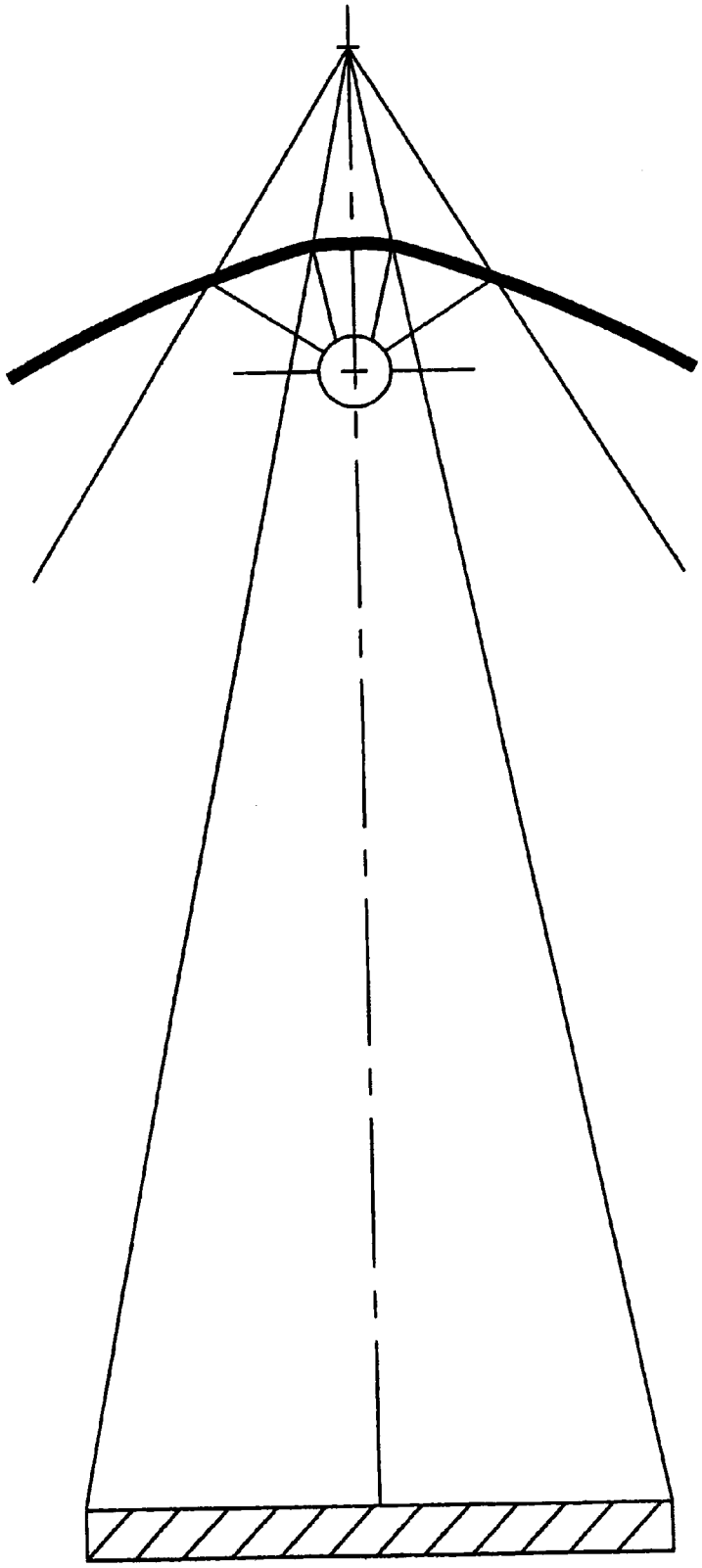
Figure 2:
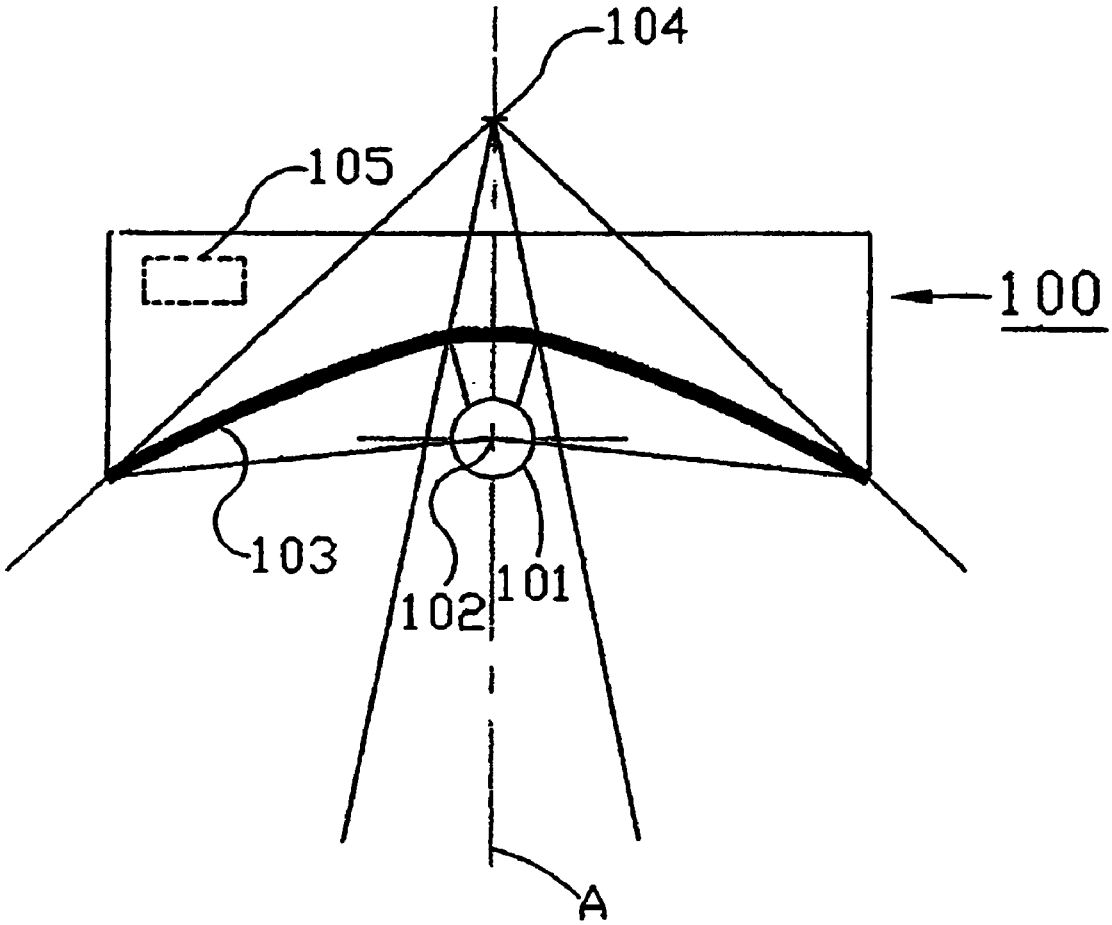
FIG. 2 is for a single elongated light source fixture 100, consisting of an elongated light source 101, located coincident with the primary focus 102 of the hyperbolic reflector 103. The center line of the fixture corresponds to the axis, A, of the hyperbolic reflector. A virtual focus 104, is located on the axis, A, and placed at a point somewhat above the reflector. The axis A of the hyperbola is defined by a straight line connecting the primary focus and the virtual focus. For a fluorescent elongated light source, a ballast 105, wiring, and fluorescent tube sockets will be required as per the known art. Typical light fixture electrical circuits can be found in Reference 3 and 4. Other than the ballast, electrical circuit components are not shown for clarity because such electrical components are obvious to anyone skilled in the art. A translucent cover can be added to the fixture to control glare.

The foregoing description of the invention has been presented for purposes of illustration and description. It is not intended to be exhaustive or to limit the invention to the precise form disclosed. Obvious modifications or variations are possible in light of the above teachings.

The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims which are appended.

I claim:

1. An article of manufacturer, namely, a single elongated light source fixture, comprising:

(A) an elongated reflector having a cross-sectional form the shape of a hyperbolic curve forming a hyperbolic reflector, said hyperbolic reflector having a primary focus;

(B) a fluorescent elongated light source, where said fluorescent light source is located coincident with said primary focus of said hyperbolic reflector.

* * * * *